United States Patent [19]

Sulz

[11] Patent Number: 4,834,286

[45] Date of Patent: May 30, 1989

[54] SPRAY GUN, MORE ESPECIALLY FOR PAINTS

[76] Inventor: Hans Sulz, Albstr. 29, 7400 Tübingen 9, Fed. Rep. of Germany

[21] Appl. No.: 68,913

[22] Filed: Jun. 29, 1987

[30] Foreign Application Priority Data

Jul. 1, 1986 [DE] Fed. Rep. of Germany ..... 3621965
Apr. 8, 1987 [DE] Fed. Rep. of Germany ..... 3711783

[51] Int. Cl.[4] ..... B05B 9/04; B05B 1/30; B05B 11/00

[52] U.S. Cl. ..... 239/124; 137/530; 239/332; 239/600

[58] Field of Search ..... 239/124–127, 239/329, 331, 332, 600; 137/530, 540

[56] References Cited

U.S. PATENT DOCUMENTS 2,587,421 2/1952 Willach ..... 137/530
2,704,690 3/1955 Eichenauer ..... 239/127
3,163,360 12/1964 McNinch, Jr. et al. ..... 239/332
3,782,412 1/1974 Darash ..... 137/540 X

FOREIGN PATENT DOCUMENTS 912560 5/1954 Fed. Rep. of Germany ..... 239/332

*Primary Examiner*—Andres Kashnikow
*Attorney, Agent, or Firm*—McGlew & Tuttle

[57] ABSTRACT

The invention provides a spray gun for liquids and more especially liquid coatings such as paints and varnishes, comprising a liquid container, a housing, a pump for the supply of the liquid from the liquid container to a spray nozzle via a spring loaded outlet valve, and a return duct connecting the outlet of the outlet valve with the container and having an adjustable valve therein. Pumping may be caused to take place by switch means on the handle. For adjustment of the further valve, which may be preferably completely shut, there is an adjustment member in the front part of the spray gun on the jet side thereof, which is decoupled from the switching on means and, while being able to be steplessly adjusted, is able to remain in each setting of its own accord. This makes it possible for the spray jet to be modified readily without interrupting spraying and even when the spraying density is very low it possible to ensure an even spray cone.

22 Claims, 4 Drawing Sheets

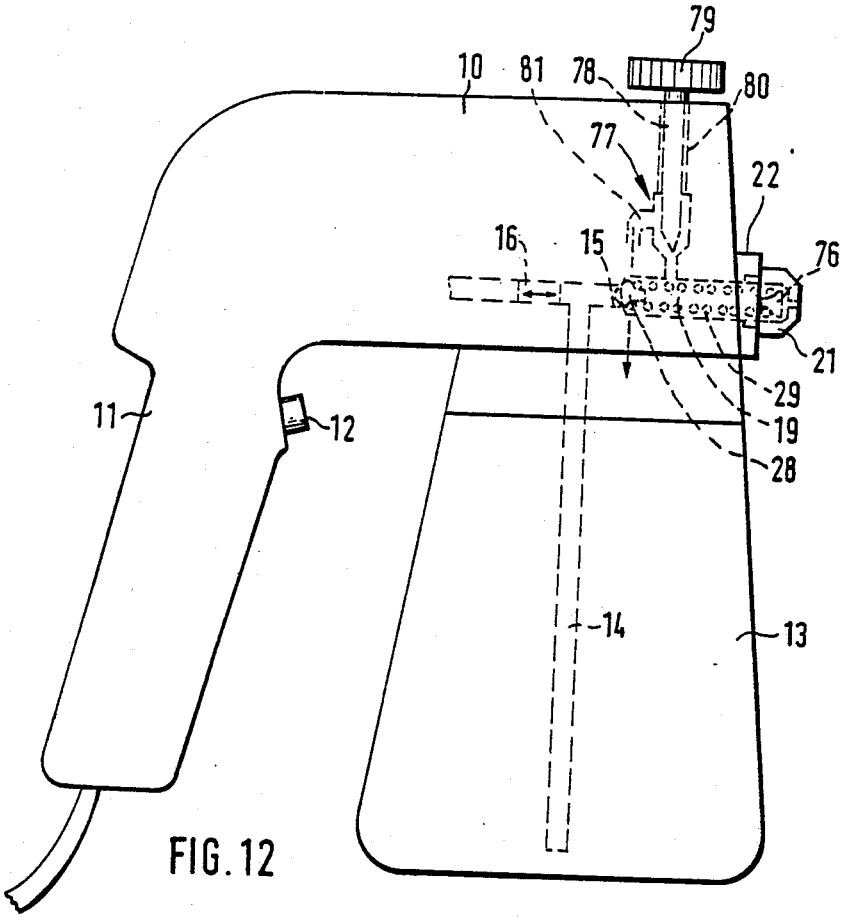
FIG. 12
FIG. 13
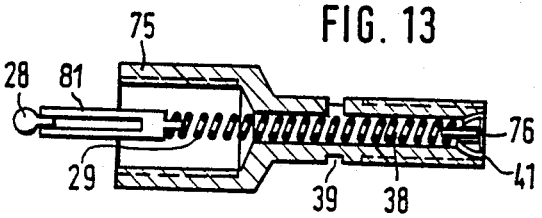

SPRAY GUN, MORE ESPECIALLY FOR PAINTSBACKGROUND OF THE INVENTION

The invention relates to a spray gun for liquids and more especially liquid coatings such as paints and varnishes, comprising a liquid container, a housing, a pump means for the supply of the liquid from the liquid container to a spray nozzle via a spring loaded outlet valve, a switching on means on a handle for causing pumping to take place, and a return duct connecting the outlet of the outlet valve with the container and having an adjustable, further valve therein.

Known spray guns normally have an electrically driven piston or diaphragm pump and for modifying the rate of spraying it is usual for the piston stroke or the motion of the diaphragm to be varied. In order to reduce the rate of spraying it is possible for example for the piston stroke to be mechanically reduced or limited. If the liquid is to be applied in a very fine state of division and the piston stroke is considerably reduced there is then a danger of the spraying pressure falling to such an extent that no even spray cone will be formed and that the liquid will be irregularly applied. If the liquid is a paint, the paint surface will not be even and large drops of paint will be blown by the spray jet onto the surface of the work. Although this danger may be mitigated by selecting a finer spray nozzle, this in turn will mean a reduction in the spray angle.

In order to change the size of the spray jet there has been a proposal in the German patent 912,560 to have a return duct for the pumped liquid between the outlet port of the pump cylinder and the spray nozzle, there being an adjustable valve in the return duct to close or open it to a greater or lesser extent against the effect of the pressure. This valve is adjusted by means of an actuating lever on the handle which switches on the pump at the same time. This actuating lever is moved as far as a preset abutment so that during the spraying operation the return valve is held at the single, defininte setting. If on the other hand the lever is not moved as far as the abutment it is not possible for a constant setting to be maintained which will mean that the spray jet is not kept constant either. An abutment screw arranged over the handle serves as a neutral position abutment on the actuating lever but however it is not suitable for setting the spray jet while spraying is actually in progress, since screwing up this abutment screw would only cause perpetual operation of the electric switch which responds to the smallest motion of the actuating lever. This would mean that the spray gun could no could no longer be switched off quickly.

SHORT SUMMARY OF THE PRESENT INVENTION

Accordingly one object of the present invention is to contrive a spray gun of the initially mentioned type which even while operating at a very low spraying rate makes it possible to simply carry out a precise adjustment of the spray jet.

In order to achieve this and/or other objects appearing from the following specification and claims, the spray gun is so designed that for adjustment of the further valve there is an adjustment member in the front part of the spray gun on the jet side thereof, which is separate from the switching on means and, while being able to be steplessly adjusted, is able to remain in each setting of its own accord.

The spray jet of the spray gun which is held by its handle and is able to be turned on and off by means on the handle may be readily be varied using the other hand to set the front adjusting member without interrupting spraying. Once the desired density of spraying has been set, it is then possible for the adjustment member to be released and the setting thereof will be adhered to, even after switching the spray gun off and on. Short-time changes in the jet density and may for instance be exactly produced by systematic turning of the adjustment member as well.

The claims define further advantageous developments and improvements of the spray gun in accordance with the present invention.

Since in the invention the further valve may be completely closed by the adjustment member there is the improvement over the initially mentioned prior art that the full spraying pressure may be used for spraying and it is not only small but also very substantial densities of spraying which may be achieved. The variability of the adjustment setting is thereby markedly increased. In this connection it is an advantage if the further valve has a spring loaded valve member whose spring bears at one end against the valve member and has its other end extending into the interior of the adjustment member which is connected with a turning knob and screws into the valve. This means that the spring loaded valve may be firmly and reliably shut without any damage or overstraining the spring.

In order to make the gun very simple to assemble and to provide a possibility of modifying exisiting existing spray guns to embody the invention by having a return duct the further valve may be such that it is able to be slipped onto or plugged into a tubular outlet duct on the spray side. The spray nozzle may be screwed on this outlet duct or on the valve directly or with an intermediate member therebetween. It is convenient if at least a part of the outlet duct is fashioned so that it may be screwed onto the housing, whereas another part is integrated in the housing. The part of the outlet duct designed to be screwed on then serves as an extension to receive the further valve in order to modify a spray gun to be in accordance with the invention.

In accordance with an advantageous design of the return means the outlet on the spray side has at least one radial port, which corresponds to a radial inlet port in the further valve surrounding the outlet duct and there is an axial outlet port on the valve which is offest in relation to the axis of the outlet duct, such outlet port corresponding to a port in the housing of the spray gun and being connected with liquid container. On slipping on the further valve all connections are thus automatically produced.

In order to make a precise alignment of the ports with each other unnecessary the corresponding ports are respectively each provided with at least one annular duct, the ports or the annular ducts being provided with seals around them. In order to improve the spraying characteristics it has been found convenient to provide a back pressure space downstream from the outlet valve so that fluctuations in pressure caused by the pulsating pump are evened out, more especially in connection with the return duct so that there is a clear improvement in the evenness of the spray jet, more especially when operating with low spraying densities. This means that the number of large drops in the spray jet practically falls to zero and in this case the spray jet is only made up of fine and medium-sized drops. This has a favorable effect on the properties of the paint coating. The back pressure space is preferably a zone with a larger internal diameter in the outlet duct in which the valve member and the valve spring of the outlet valve may also be accommodated.

Two working embodiments of the invention with possible slight modifications therein will be described with reference to the accompanying drawings in detail and by way of example only.

LIST OF THE SEVERAL VIEWS OF THE DRAWINGS

FIG. 12 diagrammatically shows a further embodiment of a spray gun with an integrated, further valve.

Figure 11:
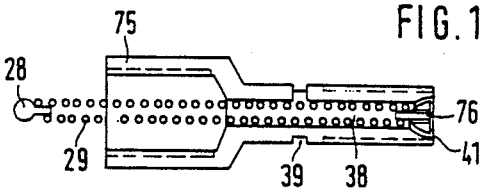
FIG. 11 shows a different mechanical desing of the adapter.

FIG. 13 is a fragmentary view of a midification of the adaptor of FIG. 11.

DETAILED ACCOUNT OF THE WORKING EMBODIMENTS OF THE INVENTION

The rear part of a housing 10 comprises a handle 11 for manipulation of the spray gun. This handle comprises an electric swich for turning a pump (not shown) in the housing 10 on and off.

In the front part of the housing 10 there is a lower liquid container 13 for the liquid to be sprayed, as for example a paint. This liquid container 13 is preferably made so that may be attached and detached by screw means. A riser pipe 14 opening into the liquid container 13 adjacent its bottom opens at its other end into a pump cylinder 15 in which a pump piston 16 is arranged so that it may be reciprocated. This piston 16 is normally driven by an AC oscillating magnet system, although this is not illustrated here. Details may be seen in the prior art initially cited. This AC magnet system may be switched on and off by the electric switch 12. The pump cylinder opens at a valve port 17, to which an outlet duct 18 is connected. Adjacent to the valve port 17 this outlet duct 18 has a larger internal diameter to serve as a back pressure space 19 in which the moving valve members are located as will be described in still further detail in connection with FIG. 2. The adjoining narrower part of the outlet duct 18 opens at a nozzle port 20 of a spray nozzle 21. Between the spray nozzle 21 and a connection member 22 on the front side of the housing 10 there is a further valve 23 making it possible to connect the narrower part of the outlet duct 18 via internal ducts with the liquid container. In this connection there is an adjustment member 24 screwing into the futher valve 23 and having a turning head 25 for its operation.

The following part of the specification describes the assembly and function of the further valve 23 with reference to FIGS. 2 to 7.

Figure 1:
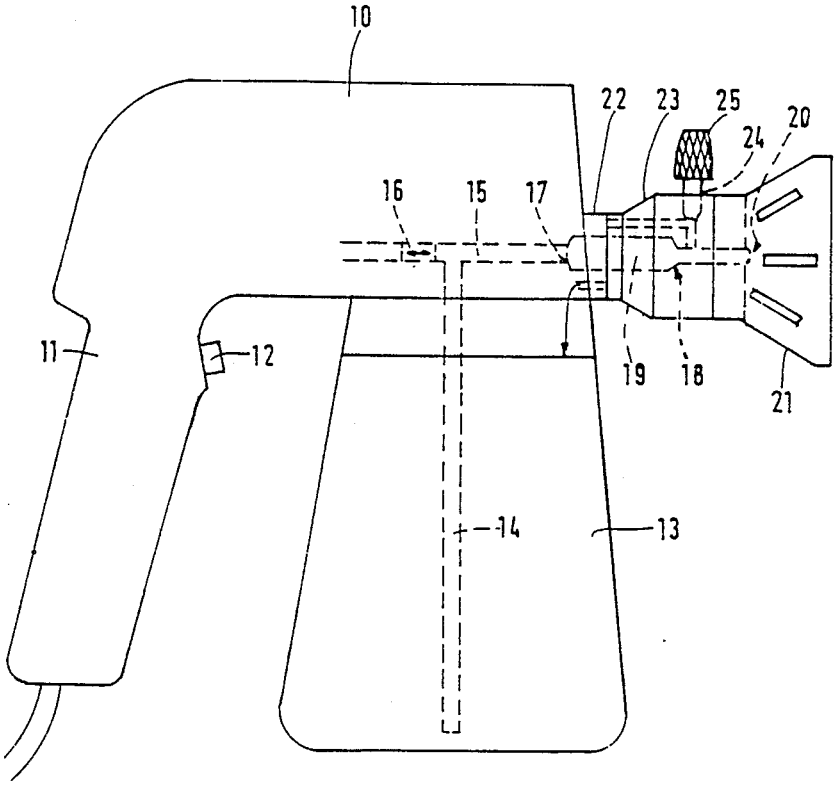
FIG. 1 is a lateral, diagrammatic view of a spray gun on whose front part there is a further valve and a spray nozzle.
Figure 2:
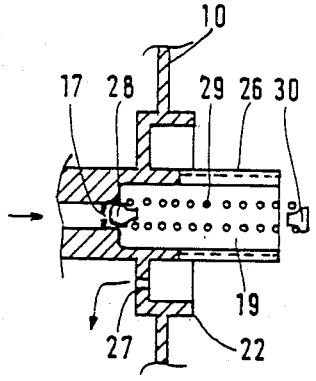
FIG. 2 is a view on a larger scale of part of a front housing of the spray gun from which the outlet duct emerges.
Figure 7:
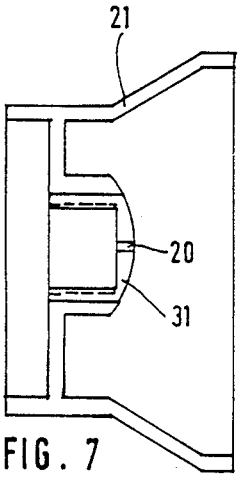
FIG. 7 shows the spray nozzle adapted to be screwed on the intermediate member.

FIG. 2 shows a front part of the housing 10 on the spray side thereof, which has the connection member 22. From the center of this connection member 22 there extends a tubular connector 26 in an outward direction which is provided with a male thread. This tubular connector 26 constitutes a part of the outlet duct 18, which comprises the back pressure space 19 with a greater internal diameter. On the housing side the back pressure space 19 opens at the valve port 17. The floor of the sleeve-like connection member 22 on the housing side has a port or hole 27 leading to the interior of the container. In this connection it is also possible to have a number of such holes 27 in place of one only. A valve member 28 is urged by a spring 29 towards the valve port 17, whose other end bears on a deflecting member 30 which in turn bears against stop which may be screwed up. In the case of prior art spray gun (for example as sold by the assignee under the designation of "640 Sl Elektronik") which however lacks the port 27 and the liquid return system, the stop is in the form of the spray nozzle 21 on the tubular connector 26 as shown in figure 7. In this connection the spray nozzle, which in other respects consists of plastic, has a metal, sleeve-like, internal member 31 whose floor has a nozzle orifice 20. The deflecting member 30 bears against this floor is aligned with and adjacent to the nozzle orifice preclude direct access to the nozzle orifice 20 so that a coned spray gun jet results. This deflecting member 30 has holes, which are not shown.

If the arrangement, which apart from the port 27 is of known design, shown in FIGS. 2 and 7 is now to be provided with liquid return system the parts shown in FIGS. 3 through 6 are placed in between having the port 27.

Figure 3:
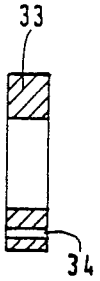
FIG. 3 shows a connecting member.

A cylindrical intermediate member 33 of plastic as shown in FIG. 3 is so dimensioned that it fits into the sleeve-like interior space of the connection member 22. It is provided with one or more holes 34 extending in direction which are aligned with the port or ports 27. In this connection the intermediate member 33 is best povided with radial groove, not shown, or a flat, which engages a correspondingly formed counter piece in the connection 27 in order to define its position about the axis of the member. It is obviously possible to also provide at least one annular groove at the opening of the port 27 or 34 with a radius equal to the distance between these holes and the center axis of the respective part. In this case twisting of the intermediate member 33 is not in any way harmful A part of the outlet duct 18 in the form of an adapter 35 is screwed on the tubular connector 26 so that the intermediate member 33 is locked in place and sealed off. A sleeve-like part 36, plced around the tubular connector 26, of the adapter 35 adjoins a cylindrical part 37 with a smaller external diameter, whose cylindrical interior space 38 also has a smaller diameter. When the adapter 35 is screwed on, the deflecting member 30 bears against the floor of the sleeve-like part 36. The cylindrical part 37 with a smaller external diameter has a peripheral groove 39, which is connected with the cylindrical interior space 38 via at least one hole. On the two sides of the peripheral groove 39 annular seals 40 are set in further peripheral grooves. The end on the spray side of the cylindrical interior space 38 has a wider part 41 to receive a further deflecting member which is not shown.

The adapter 35 serves to accommodate the further valve 23. In this connection the latter has a valve housing 42, whose internal space 43 is shaped to match the outer form of the adapter 35. The valve housing 42 is slipped onto the adapter 35 and locked in place by means of an intermediate member 44 (see FIG. 6) able to be screwed onto the adapter. In this connection the intermediate member has a female thread corresponding to the male thread of the adapter and it also has a hex nut head 45 for use with a wrench. The valve housing 42 has an annular groove 46 on the end face turned towards the housing 10 with a radius equal to the distance of the hole 34 from the center axis. Furthermore the interior space 43 is provided with a peripheral groove 47 which is on the peripheral groove 39 of the adapter when the valve housing 42 is assembled.

An axial hole 48 extending from the annular groove 46 and a radial hole 49 extending from the peripheral groove 47 open into a valve space 50, which as an extension of the radial hole 49 with a larger internal diameter runs as far as the outer side of the valve housing 42. This valve space 50 has a female thread into which the adjustment member 24 may be screwed. The adjustment member 24 has an axial blind hole 51 for a valve spring 52 for urging the valve member 53, designed in the form of a ball, against the opening of the radial hole 49 constituting the valve seat. When the adjustment member 24 is screwed home, the spring force exerted thereby on the valve member 53 increases progressively until the end face of the adjustment member 24 bears against the valve member 53 so that the valve is completely closed. The valve spring 52 is then entirely within the blind hole 51.

Lastly the spray nozzle 21 is screwed onto the intermediate member 44 which has a male thread corresponding to the male thread on the tubular connector 26.

In the event of the valve 23 being completely shut the spray gun will operate conventionally, that is to say the full spray pressure as set will act on the liquid to be sprayed. If now the spraying density is to be reduced, the adjustment member 24 may be screwed outwards without having to interrupt spraying so that, dependent on the spray pressure and dependent on the adjustment of the adjustment member 24 a fraction of the liquid will be forced back via the holes 49 and 48, the annular groove 46, the hole 34 and the hole 23 to the liquid container 13. Then the back pressure space 19, which is larger than in conventional spray guns, will have a favorable effect on the spraying performance since it forms a buffer smoothing out fluctuations in pressure which are normally to be expected. Owing to the return of the liquid it is always possible for liquid to flow back into the back pressure space and thus be pumped to the spray nozzle 21 which leads to efficient atomisation even if only at very small rates of application through the spray nozzle 21. Interruptions in the pumping action, which may occur in conventional spray guns owing to the intermittent action of the pumping means, more especially while operating at low spraying rates so that there would be an irregular ejection of the liquid, are thus quite out of the question with the system of the invention.

It would obviously be possible to reduce the number of parts shown in FIGS. 2 through 7 by combining some of the parts shown. This would be more particularly called for if the additional valve 23 is not a part supplied for the modification of an existing spray gun but as part of regularly produced spray guns. This valve 23 may also be designed to be screwed on. Additional annular ducts and seals may be provided in this connection as required.

The liquid return system in accordance with the invention is not limited to spray guns with an electric piston pump and may for instance be applied to spray guns with a diaphragm pump and to spray guns with a pump means separate from the spray guns itself and with a separate liquid container. Further types of pumping means would also be conceivable.

Known means for reducing the pumping rate, as for instance a device for reducing the piston stroke in accordance with the initially mentioned prior art, may obviously used in addition.

Figure 5:
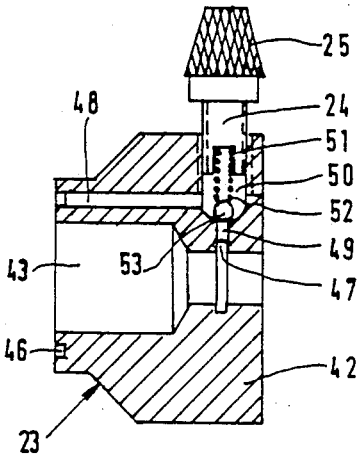
FIG. 5 shows the further valve.
Figure 8:
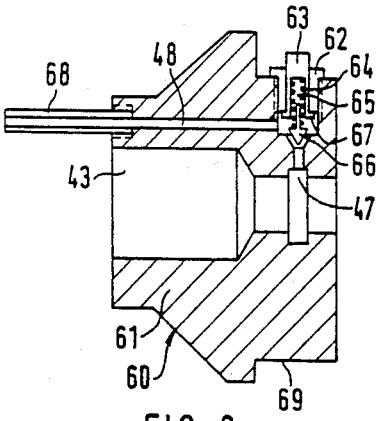
FIG. 8 shows a further design of the further valve.
Figure 9:
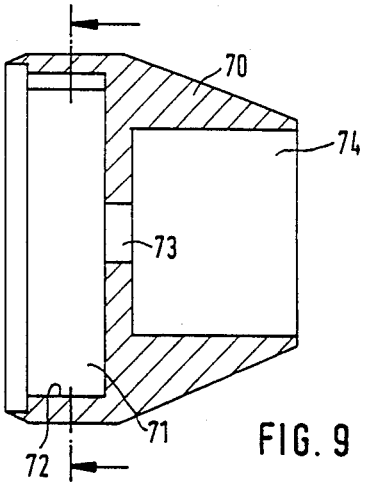
FIG. 9 shows an adjustment member for the valve illustrated in FIG. 8.
Figure 10:
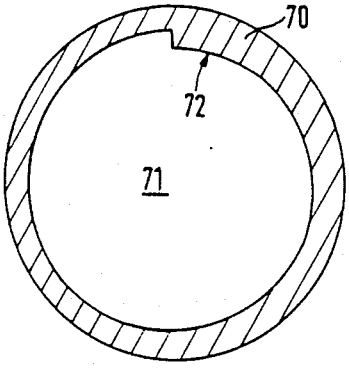
FIG. 10 is a cross sectional view taken on the section line I-I of FIG. 9.

FIGS. 8 through 10 show a further design of valve 60 as an alternative to the further valve 23 of FIG. 5. The valve 60 comprises a valve housing 61 which is generally identical to the valve housing 42 already described supra and on which it is also possible for the adapter 35 to placed. Identical or functionally similar parts are provided with the same reference numerals as in the previous description and are not described again. A retainer part 62 is screwed into the female thread of the valve space 50 and from the inside a valve sleeve-form cam followed 63 may plugged into it so as to be able to slide. A valve spring 64 extends into an axial blind hole or bore 65 of a stem portion of the cam followed 63 with its other end bearing on a valve member 66. The inner end of the stem portion of the cam followed 63 is provided with an abutment 67 defining an annular stop whereas the outer end projects from the retainer part 62 when the abutment is in the engaged state. At its outer end the axial hole 48 extending from the valve space 50 is provided with a connecting tube 68 which may be so inserted into an opening in the housing 10 that the emerging paint or other liquid finds its way into the liquid container.

The valve housing 61 has a flat 69 adjacent to the retainer part 62. A cam member 70 represented in FIG. 9 may be so slipped over the valve housing 61 that the part having the flat 69 of the valve housing 61 extends into correspondingly formed interior space 71 of the cam member 70. The inner surface 72 engaging the cam follower 63 of the adjustment member is in the form of a wedge surface with a circular curvature so that on twisting the cam follower 70 the adjustment member 63 is inserted into the valve housing 61 to a greater or lesser extent.

Figure 6:
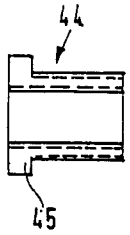
FIG. 6 shows an intermediate member for attachment of the further valve on the adapter.

The cam member 70 has an axial hole 73 to receive the adapter 35 and it is locked axially in place by the intermediate member 44 shown in FIG. 6.

Although for simplfication seals for the valve space 50 or in other leadthroughs are not shown, they are provided. Elastic rings or resilient disks are also omitted from the drawings, which may be provided to hold the cam member 70 in any of its possible settings as desired, as for example between it and the intermediate member.

In place of providing a seal means for the cam follower 63 with a sealing ring its inner end may also engage a resilient diaphragm, which simultaneously provides the sealing function and the spring action. This diaphragm then serves as an abutment for the valve member 66.

The spray nozzle may simply be in the form of the metallic inner part 31, since the outlet side port 74 of the adjustment member 70 may perform the function of the sealing member surrounding the nozzle orifice 20. By turning the cam member 70 it is possible for the cam follower 63 to be placed in the desired setting, in which a given spring force will act on the valve member 66. If the spraying pressure exceeds this spring force the liquid or paint will flow back through the opened valve and the axial hole 48. The valve member 66 then engages cam follower 63 so that its setting also determines the choking action of the valve.

Figure 4:
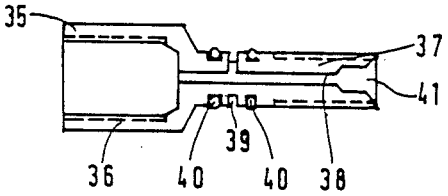
FIG. 4 shows a part of the outlet duct designed in the form of an adapter.

FIG. 11 shows a further possible form of the adapter 75 as an alternative to that of FIG. 4. The interior space 38 with a cylindrical wall in this case has a larger diameter so that the stressed spring 29 is able to extend therethrough. It now extends between the valve member 28 and a deflecting member 76 in the wider part 41. As result the mechanical design becomes simpler and the valve member 28 may be removed, for example by unscrewing the spray nozzle together with the spring and the deflecting member 76. This simplifies servicing and cleaning. If suitably designed (as regards its diameter, the distance between its turns etc.), the spring 29 may additionally improve swirling or eddying of the liquid flowing through. In order to limit the length of the spring it is also possible to have an intermediate member 81, in tandem with the spring 29 i.e. between the end of the spring remote from valve member and said deflecting member. This intermediate member may also be designed to improve the flow conditions.

In the further embodiment of a spray gun of the invention shown in FIG. 12 there is a further valve 77 arranged in the housing 10. The back pressure space 19 is located in the interior of the housing 10 whereas on the outside of the housing there is only a screw-on conventional spray nozzle 21. An adjustment member 78 extends into the valve space 50 connected with the back pressure space 19 and this member 78 reaches as far as the outer side of the housing where it is provided with a turning knob 79. The setting of the valve is again brought about by turning the adjustment member 78 in a thread 80 using the knob 79. A return duct 81 serves to connect the valve space 50 with the liquid container 13 as is symbolically indicated.

The adjustment member 78 may obviously be also designed as in the previously described forms of the invetion, and more especially it may be spring loaded to cause it to engage its seat. It is furthermore possible to have a design such that the adjustment member 78 projects from the side of the housing 10 and the turning knob 79 is then to the side of the housing. This turning knob may then be preferably in the form of a flat disk and be knurled.

The adjustment member may for example be a disk with a round hole or a tapering slot therein which may be used to vary the cross section of a return duct.

The term spray gun is obviously used herein to denote all spraying instrumentalities adapted to eject a liquid such as a liquid paint, under pressure from a nozzle. Such spray equipment may naturally depart from the form of conventional form of a gun as a weapon and may for instance be fixed in place in automatic spray coating systems.

I claim:

1. A spray gun for liquids comprising:

a liquid container;

a housing connected with said container and having part thereof in the form of a handle;

a spray nozzle;

pump means including a spring-loaded outlet valve for the supply of liquid from said container to said nozzle;

a switch in said handle for controlling said pump means;

a tubular outlet duct extending between said outlet valve and said nozzle;

a return duct leading from the outlet duct to the container and having a further, adjustable valve therein;

an adjustment member for adjusting said further adjustable valve, which adjustment member is decoupled separate from said switch and can remain in any desired setting;

said further valve being able to be located on a male part of the outlet duct;

the spray nozzle being screw-fitted onto the outlet duct;

an intermediate member screw-fitted onto the outlet duct between the spray nozzle and the further valve thereby to lock the further valve on the outlet duct.

2. The spray gun as claimed in claim 1 wherein said further valve is able to be completely shut.

3. The spray gun as claimed in claim 1 wherein said further valve comprises a spring-loaded valve member whose spring bears at one end against the valve member and at the other against the adjustment member.

4. The spray gun as claimed in claim 3 wherein said spring extends into an inside part of the adjustment member.

5. The spray gun as claimed in claim 3 wherein the adjustment member is adjustably arranged in a valve thread and includes a turning knob thereon.

6. The spray gun as claimed in claim 3 in which the adjustment member comprises cam forllowing means and a cam member having a cam surface means thereon adapted to act on an end of the cam following means remote from said further valve member in opposition to the further spring force.

7. The spray gun as claimed in claim 6 wherein said cam surface is an inner surface of the cam member which is in a round form and is rotatably mounted.

8. The spray gun as claimed in claim 1 wherein said adjustment member is rotatably attached to the valve by way of the intermediate member, and the force of said valve be adjusted.

9. The spray gun as claimed in claim 1 wherein the outlet duct has at least one radial port aligned with a radial inlet port of the further valve, which is fitted around the outlet duct, said further valve having an axial outlet port offset in relation to the axis of the outlet duct, said outlet port being aligned with a port in the housing, said port being jouned with the container.

10. The spray gun as claimed in 9 wherein at least one of said aligned ports is provided with an annular groove.

11. The spray gun as claimed in claim claim 1 wherein at least a part of the outlet duct cam be screwingt onto the housing.

12. The spray gun as claimed in claim 11 wherein said outlet valve has a valve member which together with a valve spring of the outlet valve are arranged in a portion of the outlet duct with a larger diameter.

13. The spray gun as claimed in claim 11 wherein said outlet valve has a valve member which together with a valve spring of the outlet valeve are arranged in a portion of the outlet duct with a larger diameter where there is a connection between parts of the said outlet duct.

14. The spray gun as claimed in clainm 11 wherein said outlet valve has a valve member and a valve spring with one end bearing against the valve member and its other end bearing against a deflecting member aligned with and adjacent to a spray orifice.

15. The spray gun as claimed in claim 14 comprising further intermediate member interposed between the one end of said valve spring and said deflecting member.

16. The spray gun as claimed in claim 1 comprising means defining a back pressure space following said outlet valve in the direction of flow.

17. The spray gun as claimed in claim 16 wherein a part with a larger diameter and an interior space of the duct define the back pressure space.

18. The spray gun as claimed in claim 16 wherein said outlet duct is made with a larger bore diameter at said outlet valve than would be necessary for receiving the diameter of a valve member and a valve spring of the outlet valve.

19. The spray gun as claimed in claim 1 wherein at least one part of the outlet duct is integrally joined with the housing.

20. The spray gun as claimed in claim 1 which sprays paint.

21. A spray gun for liquids comprising:

a liquid container;

a housing connected with said container and having part thereof in the form of a handle;

a spray nozzle;

pump means including a spring-loaded outlet valve for the supply of liquid from said container to said nozzle;

a switch in said handle for controlling said pump means;

a tubular outlet duct extending between said outlet valve and said nozzle;

a return duct leading from the outlet duct to the container and having a further, adjustable valve therein;

an adjustment member for adjusting said further adjustable valve, which adjustment member is separate from said switch and can remain in any desired setting;

said further valve being mounted to extend around the tubular outlet duct;

the outlet duct having at least one radial port and the further valve having a radial inlet port, at least one of said ports being provided with an annular groove aligned with the other port when the further valve is mounted around the outlet duct, said further valve having an axially extending outlet port offset in relation to the axis of the outlet duct, said outlet port being aligned with a return port provided in the housing and joined with the container.

22. A spray gun for liquids comprising:

a liquid container;

a housing connected with said container and having part thereof in the form of a handle;

a spray nozzle;

pump means including a spring-loaded outlet valve for the supply of liquid from said container to said nozzle;

a switch in said handle for controlling said pump means;

a tubular outlet duct screw-fitted to the housing extending beween said outlet valve and said nozzle;

a return duct leading from an outlet of said valve to the container and having a further, adjustale valve therein;

an adjustment member for adjusting said further adjustable valve, which adjustment member is separate from said switch and can remain in any desired setting;

said further valve being mounted on the tubular outlet duct;

the spray nozzle being screw-fitted onto the outlet duct with a spray ouifice at the end thereof;

a deflection member in the outlet duct adjacent the spray orifice;

the outlet valve spring being located in the outlet duct with one end bearing against the outlet valve member;

an intermediate member located between the other end of said outlet valve spring and said deflecting member with the outher end of the outlet valve spring bearing against the intermediate member so as to urge the deflecting member towards the spray orifice.

* * * * *